United States Patent [19]

Yokoyama et al.

[11] Patent Number: 4,936,240

[45] Date of Patent: Jun. 26, 1990

[54] STRUCTURE FOR HOLDING UNDERWATER PROJECTIONS

[75] Inventors: Fumitaka Yokoyama; Masayuki Hattori; Tsukasa Okuzaki, all of Shizuoka, Japan

[73] Assignee: Yamaha Hatsudoki Kabushiki Kaisha, Shizuoka, Japan

[21] Appl. No.: 305,253

[22] Filed: Feb. 1, 1989

[30] Foreign Application Priority Data

Feb. 9, 1988 [JP] Japan ..... 63-29970

[51] Int. Cl.[5] ..... B63B 1/30

[52] U.S. Cl. ..... 114/282

[58] Field of Search ..... 114/274, 278, 279, 280, 114/281, 282; 440/56, 64; 403/2

[56] References Cited

U.S. PATENT DOCUMENTS

| | | | |
|---|---|---|---|
| 3,910,215 | 10/1975 | Soderman | 114/282 |
| 4,364,324 | 12/1982 | Warner | 114/282 |
| 4,701,144 | 10/1987 | DeWitt | 114/282 |

FOREIGN PATENT DOCUMENTS

| | | |
|---|---|---|
| 196883 | 9/1986 | Japan . |
| 200079 | 9/1986 | Japan . |
| 200080 | 9/1986 | Japan . |
| 143794 | 6/1987 | Japan . |
| 289495 | 12/1987 | Japan . |
| 13896 | 1/1988 | Japan . |

*Primary Examiner*—Joseph F. Peters, Jr.
*Assistant Examiner*—Jesüs D. Sotelo
*Attorney, Agent, or Firm*—Jordan and Hamburg

[57] ABSTRACT

A structure for holding an underwater projection projecting downward from the bottom of hull of a hydrofoil craft or the like. The projection is connected at its rear end base portion to the hull by a hinge pivotally movably rearward and held at its front end base portion in a predetermined downwardly projecting state by a breakable holder. The projection is held in this state during usual navigation. The holder breaks when a predetermined force acts rearward on the projection, permitting the projection to move about the hinge, whereby the projection is prevented from damage.

6 Claims, 5 Drawing Sheets

STRUCTURE FOR HOLDING UNDERWATER PROJECTIONS

BACKGROUND OF THE INVENTION AND RELATED ART STATEMENT

The present invention relates to structures for holding underwater projections such as the struts of hydrofoil craft with submerged foils.

Underwater projections projecting downward from the bottoms of hulls, such as struts of submerged hydrofoils and outboard engines of small boats, are usually fixed to the hull so as to remain projected as specified against the water pressure acting thereon during navigation.

When the underwater projection of the above conventional structure collides with an obstacle, the projection or the projection attaching portion of the hull becomes damaged or broken since the projection is firmly attached to the hull. The conventional structure therefore has the problem of necessitating much time and labor for the repair.

On the other hand, proposals have been made to avoid the damage to the hull by providing shock absorbing means which is adapted to permit the underwater projection to escape rearward when the projection is subjected to a force exceeding a certain magnitude. However, the structure concerned becomes very large, complex and expensive since it must be adapted to usually hold the projection in its fixed position against great forces but to perform the shock absorbing function only when a further greater force acts on the projection.

SUMMARY OF THE INVENTION

The main object of the present invention, which has been accomplished to eliminate these drawbacks of the prior art, is to provide a device of simple construction capable of holding an underwater projection in its fixed position and yet adapted to prevent damage to the projection or the projection attaching portion of the hull against the impact exerted by an obstacle.

The present invention provides a structure for holding an underwater projection characterized in that the projection is attached to a hull and projects downward from the bottom of the hull, the projection being connected at its rear end base portion to the hull by engaging means pivotally movably rearward and being held at its front end portion in the downwardly projecting state as specified by breakable holding means, the holding means being breakable by a predetermined force acting rearward on the projection to permit the projection to pivotally move about the engaging means.

The underwater projection may comprise a strut having a submerged hydrofoil attached to its lower end. The breakable holding means may comprise a rib attached to the front end portion of the underwater projection, a rib provided at the front end of the projection attaching hull portion, and a member breakable by a predetermined tensile force and interconnecting the ribs. Alternatively, a wire connected to a front end intermediate portion of the underwater projection extends into the hull and is connected to the hull inside thereof by the breakable holding means.

When the predetermined force or a greater force acts on the underwater projection, the breakable holding means breaks to release the projection from the held state, permitting the projection to pivotally move rearward about the engaging means. This precludes excessive forces from acting on the projection attaching hull portion, consequently preventing damage to the hull.

DESCRIPTION OF THE PREFERRED EMBODIMENTS

Figure 1:
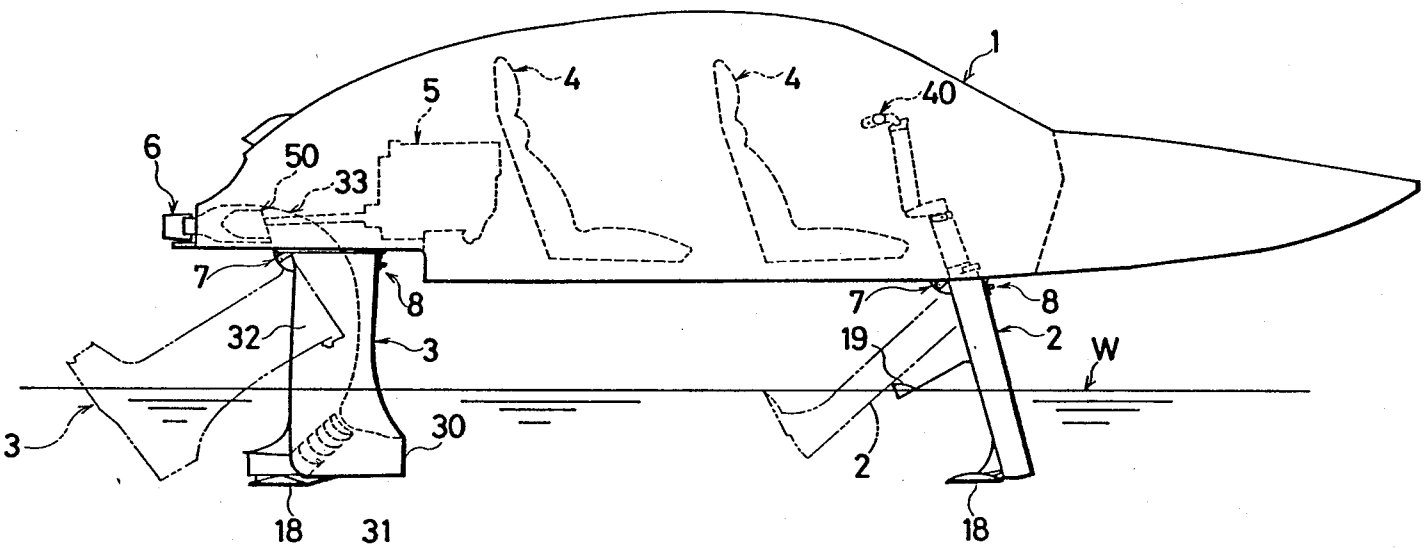
FIG. 1 is a schematic side elevation of a hydrofoil craft with submerged foils embodying the invention.

With reference to FIGS. 1 to 4, a hull 1 has a pair of forward and aft struts (underwater projections) 2, 3 attached to its bottom and projecting downward. Each of the struts is provided at its lower end with a submerged hydrofoil 18 extending widthwise of the hull. Front and rear two seats 4 are provided inside the hull 1 to afford a two-man craft. A steering wheel 40 is disposed in front of the front seat 4. Indicated at 19 is a member slidable on the surface of water. The slidable member 19 is connected to the hydrofoil 18 therebelow by an unillustrated link assembly, such that the up-and-down movement of the slidable member 19 as it slides along on the water surface W rocks the hydrofoil 18, thereby holding the hull 1 lifted to a predetermined level at all times.

The aft strut 3 is internally formed with a water channel 32 extending vertically and having a water intake 30 at the front side of its lower end. A packing 39 provided at the upper end of the strut around the channel opening is in contact with the hull bottom plate around an opening therein to afford a watertight structure for holding the channel 32 in communication with a water channel 33 formed inside the hull 1. The water drawn in through the intake 30 is guided upward through the channel 32 by a guide vane 31 and jetted out in a specified direction from a nozzle 6 at the stern by a water jet pump 50 driven by an engine 5, whereby the craft is propelled and turned.

Figure 2:
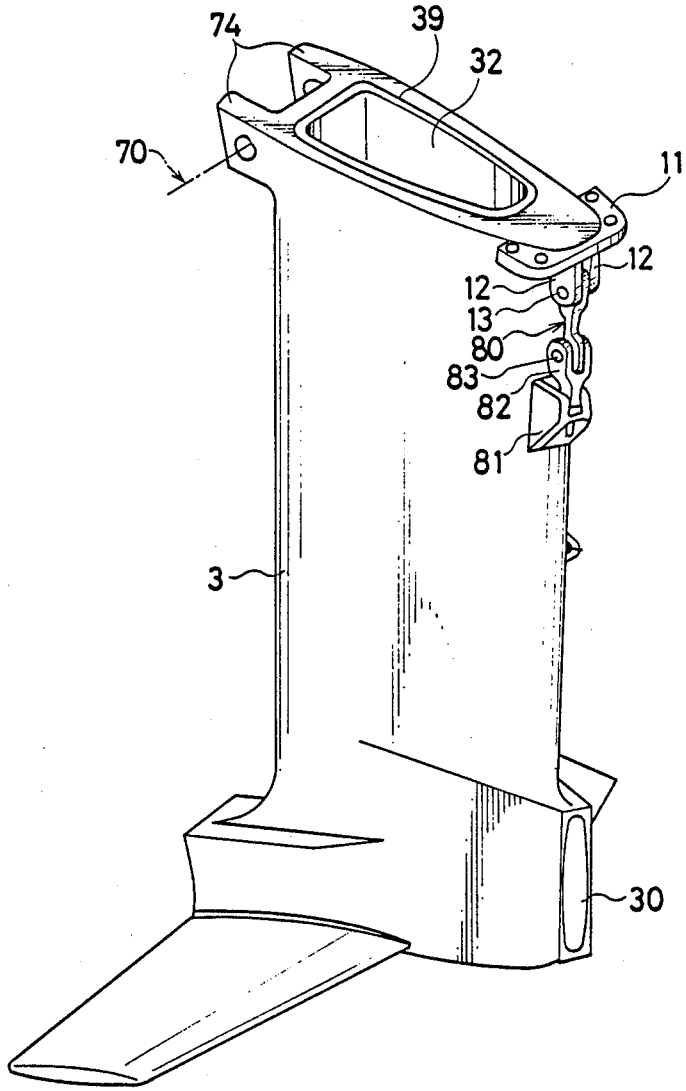
FIG. 2 is an enlarged perspective view showing a strut.
Figure 3:
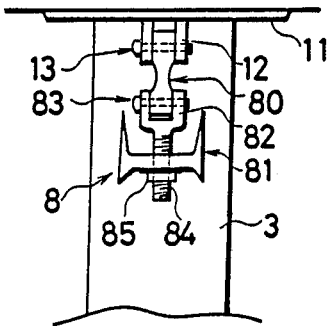
FIG. 3 is a front view showing breakable holding means.
Figure 4:
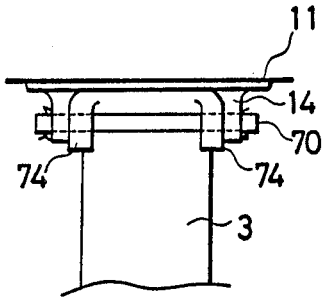
FIG. 4 is a front view showing hinge means.

Each of the struts 2, 3 is connected at its rear end base portion to the hull 1 by hinge means (engaging means) 7 pivotally movably rearward and held at its front end base portion in a specified downwardly projecting state by breakable holding means 8. As shown in FIGS. 2 and 3, the hinge means 7 comprises ribs 74 provided at the rear end base portion of the strut 3, ribs 14 attached to a reinforcing plate 11 secured to the hull 1, and a bolt 70 inserted through these ribs 74, 14 widthwise of the hull. The strut 3 is pivotally movable about the bolt 70.

The breakable holding means 8 comprises ribs 12 attached to the reinforcing plate 11 secured to the bottom of the hull 1, a support member 81 secured to the strut 3, a bifurcated connecting member 82 connected to the support member 81 by a screw portion 84 screwed through nut 85, and a breakable member 80 having its opposite ends connected to the ribs 12 and the connecting member 82 by pins 13, 83, respectively. The breakable member 80 is made of aluminum or the like so as to break when subjected to a predetermined tensile load.

Although the hinge means 7 and the breakable holding means 8 are illustrated in detail only for the strut 3, those for the strut 2 have the same construction as described above.

Figure 5:
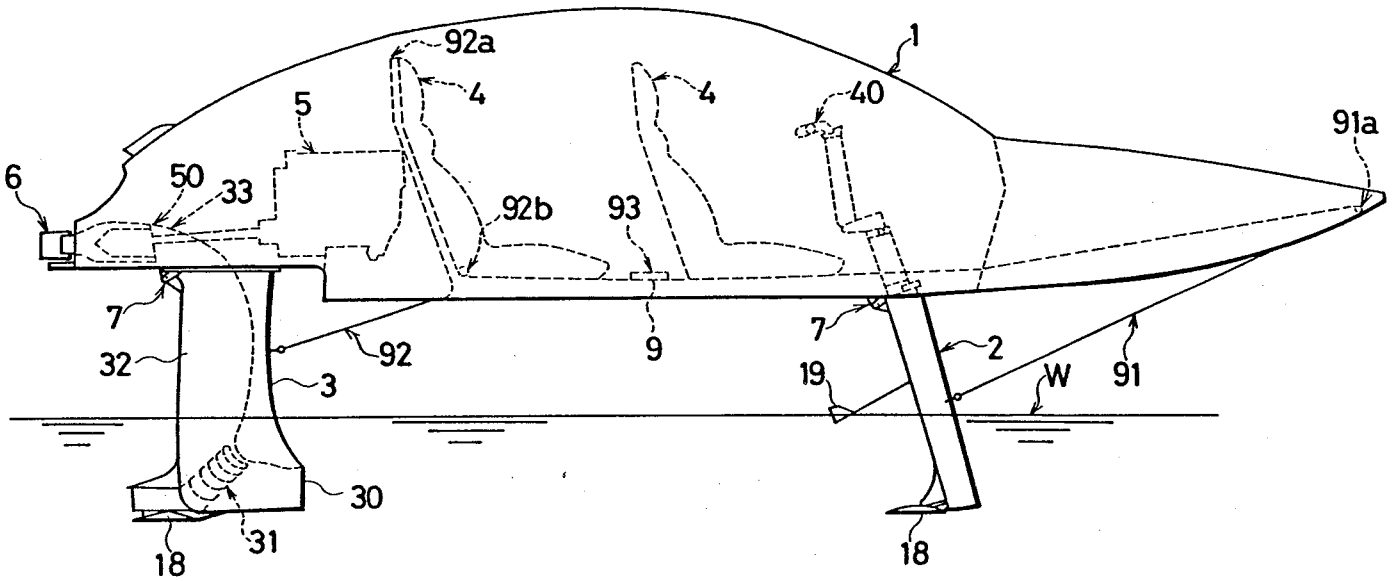
FIG. 5 is a view corresponding to FIG. 1 and showing another embodiment of the invention.
Figure 6:
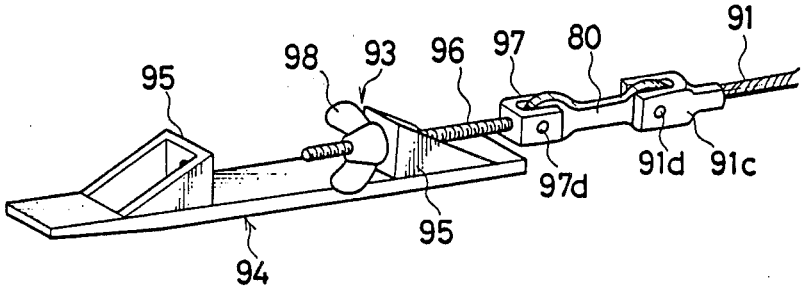
FIG. 6 is an enlarged perspective view of the breakable holding means thereof.

FIGS. 5 and 6 show another embodiment of the invention wherein breakable holding means 9 comprising wires 91 and 92 is used in place of the holding means 8 described. The wire 91 is connected to a front end intermediate portion of the strut 2, passed over a pulley 91*a* in the vicinity of the stem and led to a connector 93 in the vicinity of the lower central portion of the hull 1 inside thereof. The wire 92 is connected to a front end intermediate portion of the strut 3, extends into the hull 1 through the bottom in front of the strut 3, further extends upward, and is passed around an upper pulley 92*a* and a lower pulley 92*b* and connected to the connector 93.

The wire 91 is led into the hull 1 at the stem because this portion is usually above the water. To preclude water from ingressing into the hull 1 through the portion where the wire 92 is led into the hull, the wire 92 is passed through a pipe extending from the hull bottom to the upper interior portion of the hull, reeved around the pulley 92*a* at this portion and led downward.

The connector 93 comprises a holder member 94 attached to the bottom of the hull 1, a pair of ribs 95 integral with the holder member 94, and a connecting member 97 screwed through the rib 95. An end member 91*c* on the wire 91 is connected to the connecting member 97 by a breakable member 80 using pins 91*d*, 97*d*. The connecting member 97 has a screw stem 96 screwed through the rib 95, and a nut 98 on the stem 96 is used for suitably tensioning the wire 91. The assembly for attaching the wire 92 to the connector 93, although not shown, has the same construction as the above assembly.

The breakable holding means 9 has the advantage that the wires 91 and 92 can be connected together by a person inside the craft.

The breakable holding means 8 or 9 of the above structure hold the struts 2, 3 in the specified position against the force acting on the struts (counterclockwise moment in FIG. 1 or 5) in the usual state of navigation. When the strut 2 or 3 is subjected to a great force on colliding with an obstacle, the breakable member 80 of the holding means 8 or 9 breaks, whereupon the front end portion of the strut 2 or 3 is released from the restraint and pivotally moves about the hinge means 7 at its rear end portion as indicated in the phantom line in FIG. 1. This precludes an excessive force from acting on the strut attaching hull portion to prevent damage to or break of the hull 1.

When the strut 3 pivotally moves upon collision with the obstacle, the water channel 33 of the hull 1 is opened downward, permitting intake of water therethrough, so that the craft is movable to a specified location by driving the water jet pump 50.

Although both the forward and aft struts are provided with the breakable holding means 8 or 9 according to the foregoing embodiments, these holding mean 8 and 9 may be used in combination. Furthermore, the breakable holding means 8 or 9 is usable for downward projections on hulls other than the struts 2 and 3. In place of the hinge means 7 used for the underwater projection, other engaging means having a similar function may be used.

According to the invention described above, the breakable holding means breaks to release the underwater projection from its held position when a predetermined or greater force acts on the projection, allowing the projection to pivotally move rearward about the engaging means, with the result that excessive forces are prevented from acting on the projection attaching hull portion to thereby prevent damage to the hull. Moreover, the breakable holding means functions as contemplated although having a very simple construction.

What is claimed is:

1. A structure for holding an underwater projection projecting from a hull which has a fore and aft axis, said underwater projection having a proximal end portion juxtaposed to said hull and an opposite distal end portion, pivot support means for pivotally supporting said proximal end portion of said underwater projection from said hull, a first connecting means connected to an intermediate portion of said underwater projection which is intermediate said proximal and distal end portions, a second connecting means connected to said hull forward of said proximal end portion, and a breakable member connected to said first and second connecting means for holding said underwater projection in a projecting position, said breakable member being breakable upon being subjected to a predetermined force acting on said underwater projection tending to pivot said underwater projection an aft direction such that upon breaking of said breakable member, said underwater projection pivots in an aft direction about said pivot support means.

2. A structure according to claim 1 further comprising another underwater projection projecting from said hull.

3. A structure for holding an underwater projection projecting from a hull which has a fore and aft axis, said underwater projection having a proximal end portion juxtaposed to said hull and an opposite distal end portion, pivot support means for pivotally supporting said proximal end portion of said underwater projection from said hull, a connecting means connected to an intermediate portion of said underwater projection which is intermediate said proximal and distal end portions, a breakable means connected to said connecting means and to said hull for holding said underwater projection in a projecting position, said breakable means having a portion connected to said connecting means and which extends upwardly and forwardly from said connecting means to said hull, said breakable means comprising a breakable member which is breakable upon being subjected to a predetermined force acting on said underwater projection tending to pivot said underwater projection in an aft direction such that upon breaking of said breakable member, said underwater projection pivots in an aft direction about said pivot support means.

4. A structure for holding an underwater projection projecting from the hull of a watercraft comprising pivot support means pivotably supporting said underwater projection from said hull, breakable means connected between said underwater projection and said hull for holding said underwater projection in a projecting position, said breakable means being breakable upon being subjected to a predetermined force such that said underwater projection pivots from said projecting position in an aft direction about said pivot support means, said underwater projection having an inlet means for receiving water as said watercraft advances through the water, said hull having a hull opening communicating with said inlet means, and propelling pump means having an aft-facing discharge nozzle, said propelling pump means being operable to receive water entering said inlet means, and to discharge said water through said aft-facing nozzle to thereby propel said watercraft through the water, said propelling pump means being operable to draw water through said hull opening to produce a propelling force for said watercraft when said breakable holding means has broken and said underwater projection has pivoted in an aft direction.

5. A structure according to claim 4 wherein said underwater projection means comprises a strut supporting a hydrofoil, said strut supporting said hydrofoil for foil-borne operation of said watercraft when said underwater projection means is in said projecting position, said watercraft being hull-borne when said breakable means breaks and said underwater projection pivots from said projecting position, said hull opening being submerged when said watercraft is hull-borne such that said propelling pump means is operable to draw in water through said submerged hull opening to propel said watercraft while hull-borne.

6. A structure for holding an underwater projection projecting from the hull of a watercraft comprising pivot support means for pivotably supporting said underwater projection from said hull, breakable means connected between said underwater projection and said hull, said breakable means being breakable upon being subjected to a predetermined force acting on said underwater projection tending to pivot said underwater projection in an aft direction such that upon breaking of said breakable means, said underwater projection pivots in an aft direction about said pivot support means, said underwater projection having a forward-facing inlet opening for receiving water as said watercraft advances through the water, said hull having a hull opening, channel means in said underwater projection extending between said inlet opening and said hull opening, and propelling pump means having an aft-facing discharge nozzle, said propelling pump means being operable to receive water entering said inlet opening and to discharge said water through said aft-facing nozzle to thereby propel said watercraft through the water, said propelling pump means being operable to draw water through said hull opening to produce a propelling force for said watercraft when said breakable means has broken and said underwater projection has pivoted in an aft direction.

* * * * *